United States Patent [19]

Chen

[11] Patent Number: 4,590,626

[45] Date of Patent: May 27, 1986

[54] HUNTING GLOVE WITH PRE-ORIENTED FOREFINGER SHEATH

[76] Inventor: Yi-Yi Chen, P.O. Box 10160, Taipei, Taiwan

[21] Appl. No.: 702,935

[22] Filed: Feb. 19, 1985

[51] Int. Cl.[4] ..... A41D 19/00; A41D 19/02

[52] U.S. Cl. ..... 2/163; 2/161 A; 2/169

[58] Field of Search ..... 2/163, 159, 161 A, 161 R, 2/169

[56] References Cited

U.S. PATENT DOCUMENTS 1,699,495 1/1929 Sturm ..... 2/161 R 4,051,552 10/1977 Widdemer ..... 2/161 A

FOREIGN PATENT DOCUMENTS 269490 7/1950 Switzerland ..... 2/159

*Primary Examiner*—Louis K. Rimrodt

*Assistant Examiner*—Joseph S. Machuga

[57] ABSTRACT

A hunting glove includes a forefinger sheath which is formed by combining a back-side cover pre-oriented towards the thumb, a fourchette inwards pre-curved towards the palm and a thenar-side cover shorter than the forefinger length so as to form a forefinger sheath pre-oriented in a style suitable for triggering a gun smoothly and precisely.

1 Claim, 8 Drawing Figures

HUNTING GLOVE WITH PRE-ORIENTED FOREFINGER SHEATH

BACKGROUND OF THE INVENTION

Conventional pre-curved glove as shown in FIGS. 7 and 8 is formed by combining the palm piece P with the back peice B wherein each finger sheath is formed by sewing the fourchettes F on the corresponding edges of thenar-side cover P1 and back-side cover B1 of each finger. The thenar-side cover P1 should be shorter than the back-side cover B1 so as to form a pre-curved shape as the side-view shown in FIG. 8. However, such a conventional pre-curved glove has the following defects:

1. When using such a glove for hunting use to trigger a gun, the sheath of forefinger will be bent as dotted line shown in FIG. 8 to cause wrinkles on the sheath leather especially on the folding portions, whereby the trigger operation is influenced and the aiming effect during hunting will be reduced.

2. Since the wrinkles are formed when folding or bending the finger sheath, the wearer will feel uncomfortable at the fingures after periodic wearing service.

3. There is much void existing between the wearer's finger and the sheath wall so that the air accumulated in the void space will be squeezed during trigger operation to increase the air pressure and the finger will become inactive to decrease the aiming precision during hunting.

The present inventor has found these defects and invented the present hunting glove with pre-oriented finger sheath.

SUMMARY OF THE INVENTION

The object of the present invention is to provide a hunting glove including a forefinger sheath which is formed by combining a back-side cover pre-oriented towards the thumb, a fourchette inwards pre-curved towards the palm and a thenar-side cover shorter than the forefinger length so as to form a pre-oriented forefinger sheath suitable for precise trigger action during hunting service.

DETAILED DESCRIPTION

Figure 1:
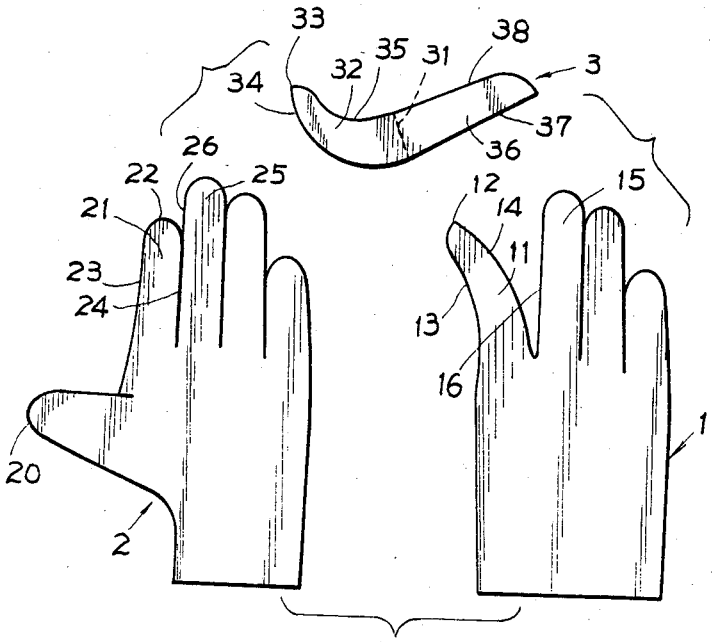
FIG. 1 is a plan-view drawing showing all parts of the present invention.
Figure 2:
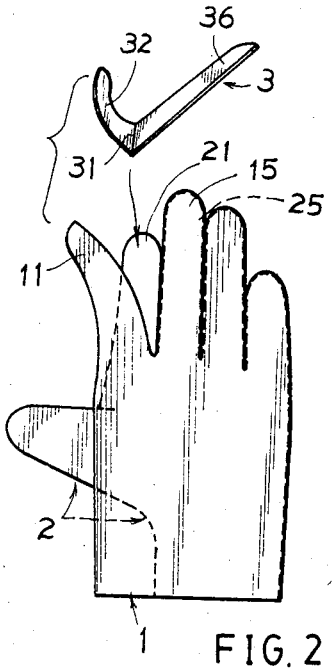
FIG. 2 shows the construction steps forming the present invention.
Figure 3:
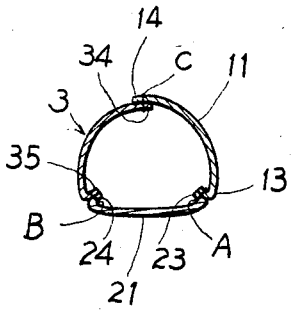
FIG. 3 is a transverse sectional drawing of the forefinger sheath in accordance with the present invention.

As shown in the FIGS. 1-6, the present invention is formed by combining a back piece 1, a palm piece 2 and several fourchettes 3 each sealing the two sheath covers of the two adjacent fingers.

The forefinger sheath is pre-oriented suitable for triggering a hunting gun and is formed by combining a back-side cover 11 pre-oriented towards the thumb, a fourchette 3 having a forfinger portion 32 inwards pre-curved towards the palm and a thenar-side cover 21 having a length slightly shorter than that of the forefinger. The combining method for forefinger sheath may be performed by sewing or other methods.

Back-side cover 11 is formed with a radial-side edge 13 pre-curved towards the thumb 20 and formed with an ulnar-side edge 12 also pre-curved towards the thumb 20, both edges being convergent to the termination of finger tip 12.

Fourchette 3 includes a forefinger portion 32 and a middle-finger portion 36, both portions 32, 36 having a central boundary line 31. Forefinger portion 32 is formed with a thenar-side edge 35 pre-curved towards the palm and formed with a back-side edge 34 also pre-curved towards the palm, both edges convergent to the termination tip 33.

Thenar-side cover 21 is formed with a radial-side edge 23 and an ulnar-side edge 24, both edges convergent to the termination tip 22. The The length of cover 21 should be slightly shorter than that of forefinger.

When assembling the present invention, the palm piece 2 is combined with the back piece 1. In order to form the forefinger sheath of this invention, the central boundary line 31 of fourchette 3 is served as a base of the forefinger and the middle finger. The ulnar-side edge 14 of cover 11 is sewn with the back-side edge 34 of fourchette 3 as mark C shown in FIG. 3. The radial-side edge 13 of cover 11 is sewn with the radial-side edge 23 of cover 21 as mark A shown in FIG. 3. The thenar-side edge 35 of fourchette 3 is sewn with the ulnar-side edge 24 of cover 21 as mark B shown in FIG. 3. The middle-finger portion 36 of fourchette 3 having a thenar-side edge 38 and a back-side edge 37 is sewn with the edge 26 of cover 25 and with the edge 16 of cover 15 respectively. The other finger sheathes may be combined by the related fourchettes (not shown) in any conventional method to form a hunting glove of the present invention. The forefinger sheath is thus formed so that the tips 12, 22, 33 will form a common tip D.

Figure 4:
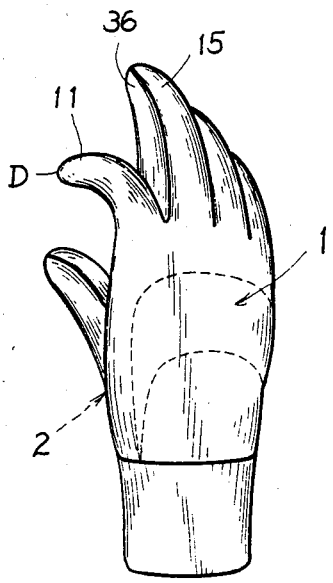
FIG. 4 shows the prespective view of the present invention.
Figure 5:
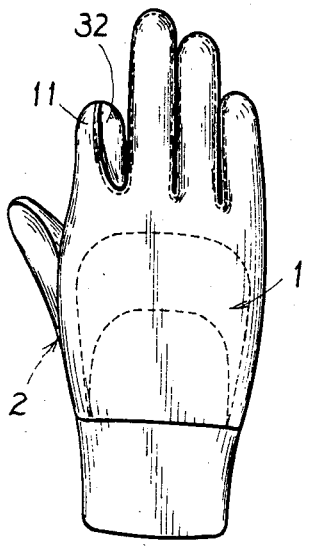
FIG. 5 is a back-view illustration of the present invention.
Figure 6:
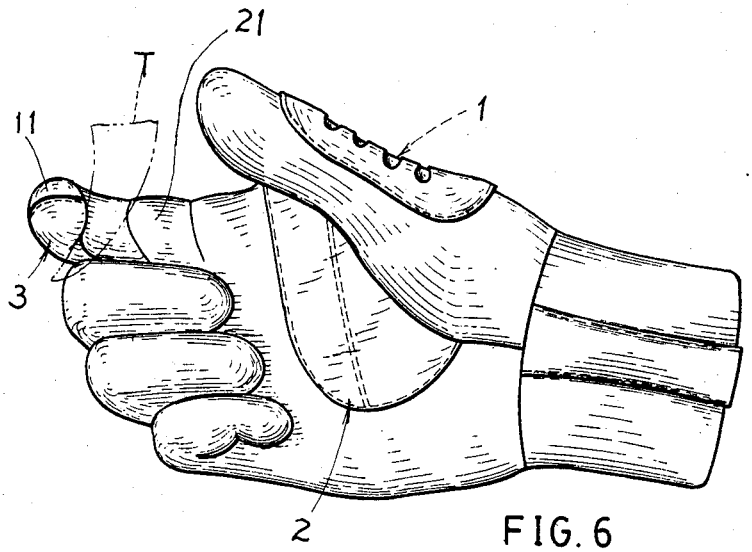
FIG. 6 is a perspective illustration when using the present invention in trigger operation.
Figure 7:
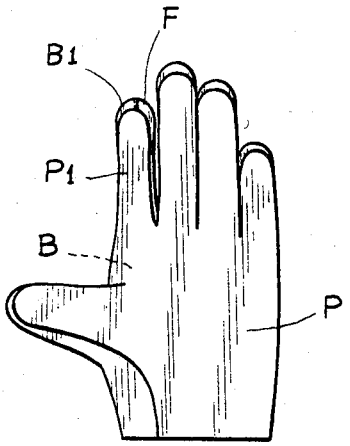
FIG. 7 PRIOR ART
FIG. 7 is an illustration showing a prior art of pre-curved glove.
Figure 8:
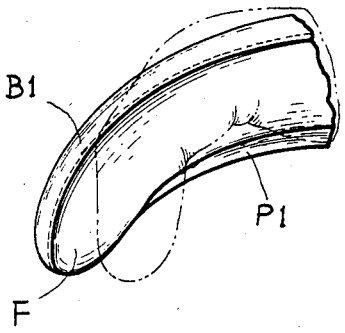
FIG. 8 PRIOR ART
FIG. 8 is a side-view illustration of a finger sheath of a glove made from FIG. 7.

Since the forefinger of the present invention is pre-oriented as FIGS. 4-6 shown, it can be smoothly used to trigger a hunting gun T as FIG. 6 shown. The present invention has the following advantages superior to conventional pre-curved hunting glove:

1. The back-side cover 11 is pre-curved towards the thumb and the fourchette 32 is pre-curved towards the palm so that after sewing the cover 11 with fourchette 32 and cover 21, the forefinger sheath will be pre-oriented in a style suitable for triggering a gun. That means the pre-oriented forefinger will be more compatible with a human forefinger for free and smooth triggering action and for more comfortable wearing.

2. The forefinger sheath is so shaped that there is no much void existing between the wearer's finger and the sheath wall. Hence, there is no wrinkle formed when folding the sheath and also no air pocked formed in the sheath so that the aiming precision when triggering a gun will not be influenced.

I claim:

1. A hunting glove comprising a pre-oriented forefinger sheath which includes: a back-side cover pre-oriented towards the thumb, and formed with a redial-side edge pre-curved towards the thumb and formed with an ulnar-side edge also pre-curved towards the thumb, both edges being convergent to the termination of forefinger tip, and said radial-side edge of said back-side cover being sewn with the radial-side edge of said thenar-side cover and said ulnar-side edge of said back-side cover being sewn with the back-side edge of a fourchette;

said fourchette having a forefinger portion inwards pre-curved towards the palm, and formed with a forefinger portion and a middle-finger portion, said forefinger portion formed with a thenar-side edge pre-curved towards the palm and formed with a back-side edge also pre-curved, both edges convergent to the termination of forefinger tip, said thenar-side edge of said fourchette being sewn with the ulnar-side edge of said thenar-side cover and said back-side edge of said fourchette being sewn with the ulnar-side edge of said back-side cover of the forefinger sheath; and a thenar-side cover having a length slightly shorter than the forefinger length, and formed with a radial-side edge and an ulnar-side edge, both edges convergent to the termination of forefinger tip, whereby said back-side cover, said fourchette and said thenar-side cover are combined to form a forefinger sheath which is oriented to be adapted for triggering a gun as compatible with the wearer's forefinger.

* * * * *